US010674825B2

(12) United States Patent
Olarte

(10) Patent No.: US 10,674,825 B2
(45) **Date of Patent: *Jun. 9, 2020**

(54) STACKABLE CHAIR

(71) Applicant: Alvaro Mauricio Olarte, Aventura, FL (US)

(72) Inventor: Alvaro Mauricio Olarte, Aventura, FL (US)

(73) Assignee: Series International, LLC, Aventura, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/685,639

(22) Filed: Nov. 15, 2019

(65) Prior Publication Data

US 2020/0077797 A1 Mar. 12, 2020

Related U.S. Application Data

(63) Continuation of application No. 14/711,409, filed on May 13, 2015, now Pat. No. 10,517,400.

(51) Int. Cl.
*A47C 3/04* (2006.01)
*A47C 1/124* (2006.01)

(52) U.S. Cl.
CPC ..... *A47C 3/045* (2013.01); *A47C 1/124* (2013.01); *A47C 3/04* (2013.01)

(58) Field of Classification Search
None
See application file for complete search history.

(56) References Cited

U.S. PATENT DOCUMENTS 1,152,480 A * 9/1915 Bouk ..... A47C 7/56 297/332
1,941,340 A * 12/1933 Dellert ..... A47C 3/023 297/239
2,610,335 A * 9/1952 Baptista ..... A47C 31/023 5/248

(Continued)

FOREIGN PATENT DOCUMENTS

GB 154332 A 9/1936
GB 493316 A 10/1938

(Continued)

OTHER PUBLICATIONS

Large chair with fold down seat by: Figueras International Seating; Dimensions 430 Delta (1 page, undated).

(Continued)

*Primary Examiner* — David R Dunn
*Assistant Examiner* — Christopher E Veraa
(74) *Attorney, Agent, or Firm* — St. Onge Steward Johnston & Reens, LLC

(57) ABSTRACT

A stacking chair with a frame connected to a rotating seating portion and backrest portion each of the seating portion and backrest portion having matching profiles such that when stacked the weight of the chairs is distributed across facing surfaces that nest together due to matching profiles, the seating portion may rotate through an angle of rotation greater than 90 degrees and the seating and/or backrest portions may include a injection molded foam interior surrounding an internal frame and with a removable cover on the outside of the foam.

19 Claims, 13 Drawing Sheets

(56) References Cited

U.S. PATENT DOCUMENTS

| | | | | |
|---|---|---|---|---|
| 3,087,755 | A * | 4/1963 | Boman | A47C 3/045 297/239 |
| 3,246,927 | A | 4/1966 | Klassen | |
| 3,446,530 | A | 5/1969 | Rowland | |
| 3,695,687 | A | 10/1972 | Uyeda | |
| 3,847,433 | A | 11/1974 | Acton et al. | |
| 3,899,207 | A * | 8/1975 | Mueller | A47C 3/04 297/239 |
| 4,189,876 | A | 2/1980 | Crossman et al. | |
| 5,609,395 | A * | 3/1997 | Burch | A47C 7/42 297/335 |
| 6,206,469 | B1 | 3/2001 | Caruso et al. | |
| 6,293,621 | B1 * | 9/2001 | Marsh | A47C 1/121 297/248 |
| 6,345,863 | B1 | 2/2002 | Laws et al. | |
| 6,786,548 | B2 | 9/2004 | Pearce et al. | |
| 8,967,714 | B2 | 3/2015 | Machael et al. | |
| 2005/0099052 | A1 | 5/2005 | Bertolini et al. | |
| 2005/0264060 | A1 * | 12/2005 | Cesaroni | A47C 3/04 297/239 |
| 2007/0120402 | A1 * | 5/2007 | Bonzini | A47C 31/023 297/219.1 |
| 2008/0284215 | A1 | 11/2008 | Stauber | |
| 2010/0194160 | A1 | 8/2010 | Machael et al. | |
| 2010/0289306 | A1 * | 11/2010 | Saul | A47C 3/04 297/239 |
| 2012/0126596 | A1 * | 5/2012 | Olarte | A47C 3/04 297/239 |
| 2015/0282622 | A1 * | 10/2015 | Kumazawa | A47C 3/045 297/335 |

FOREIGN PATENT DOCUMENTS

| | | | |
|---|---|---|---|
| GB | 637911 | A | 5/1950 |
| GB | 2098471 | A | 11/1982 |

OTHER PUBLICATIONS

Fold down seat for public spaces by: Figueras International Seating; Dimensions 630 Tulipa (1 page, undated).
Stacking Chair Designs by: Various Companies in USA (5 pages, undated).

* cited by examiner

STACKABLE CHAIR

FIELD OF THE INVENTION

The invention relates to chairs, more particularly chairs that are foldable and/or stackable.

BACKGROUND OF THE INVENTION

There are many versions of stacking chairs available that are designed for temporary seating in small and large areas, auditoriums or other event spaces. In one exemplary use of such chairs, a school may have a gymnasium that serves both for athletic purposes and for school meeting purposes. Folding chairs are needed for the meeting purposes, but would get in the way of the athletic uses. Therefore, chairs have been designed to stack upon each other so that when not in use, they can be stored in a relatively small space.

The process of un-stacking and stacking the chairs for storage and use often causes the chair frames to rub against each other which can damage the finish. In some cases, metal on metal contact can cause chairs to become stuck due to the concentration of the weight of many chairs onto relatively small contact areas. For example, the bottom two chairs in a stack of ten or more may become stuck together or difficult to remove from each other.

In addition, many of the stacking chairs do not include the ability to have a tilting seating surface. Some common folding chairs may fold flat, for stacking when flat, but when opened, the seating area often cannot be tilted relative to a generally stationary frame. Since many stacking chairs are designed for frame to frame contact, padding on the chairs is often minimal because the padding takes up a large amount of space. Since some prior art stacking chairs are often designed for frame on frame contact to avoid surface to surface contact of the upholstered seat, adding padding reduces the number of chairs that can be stacked and still fit in typical door heights found in many buildings.

SUMMARY OF THE INVENTION

One object of the invention is to provide a stacking chair that distributes the mass of multiple chairs across a relatively large surface area.

Another object of the invention is to provide a stacking chair that avoids contact between legs and/or reduces the contact force between legs to reduce the likelihood that chairs will become stuck together or damaged upon stacking.

Yet another object of the invention is to provide a tilt mechanism that allows for increased rotation of the seat of the chair, which may provide increased space in aisles which could make it easier people to fill in rows while reducing the spacing between rows.

Yet other objects of the invention are to provide a comfortable stacking chair that is padded and is also space saving in storage.

These and other objects are achieved by providing a chair with a frame connected to a rotating seating portion and backrest portion each of the seating portion and backrest portion having matching profiles such that when stacked the weight of the chairs is distributed across facing surfaces that nest together due to matching profiles, the seating portion may rotate through an angle of rotation greater than 90 degrees and the seating and/or backrest portions may include a injection molded foam interior surrounding an internal frame and with a removable cover on the outside of the foam.

In one aspect one cross section of the seating portion defines a first set of two profiles of matching shape one of which corresponds to a seating surface, and a cross section of the backrest portion defines a second set of two profiles of matching shape one of which corresponds to a backrest surface. The seating or backrest surfaces may be curved in a first plane perpendicular to a second plane where the second plane corresponds to the first or second set of two profiles. The seating portion may rotate about an axis parallel to the first plane and the axis of rotation may be located between the first set of two profiles.

The first or second sets of two profiles may correspond to 25%-100% or preferably 50%-90% of the corresponding seating or backrest surfaces across the corresponding seating or backrest surfaces and along the axis. In some cases the frame has a first section of a thickness less than a thickness of the seating portion where the axis passes through the first section. This may help avoid frame to frame contact.

A guard may be connected or may surround to the first section and may extend below a bottom of the first section at a distance corresponding to a difference between a thickness of the seating portion and the first thickness. This may enable contact between both the guard and the seating/backrest surfaces when chairs are stacked. The top and bottom surfaces of the guard may have profiles that match to enable nesting of the guards when stacked.

The seating portion may be configured to rotate freely relative to the frame between first and second positions such that an angle of rotation between the first and second positions is greater than 90 degrees. In some cases, this may allow for additional space in rows of seats as people move in and out of the rows.

An interior cavity of the seating or backrest portions may include an internal frame and a compressible padding material injection molded around the internal frame. This may add comfort to the chair while also providing sufficient structural rigidity and resilience in a compact size to enable easy stacking and storage.

In order to avoid frame on frame contact, the first section of the frame may have a thickness greater than that of the seating portion. The seating portion may be connected to the first section at a rotation axis located between first and second surfaces of the seating portion wherein at least part of the first surface and at least part of the second surface define two matching profiles and the first surface is a seating surface. A second thickness measured between the first and second surface may be greater than the first thickness. This may cause the first sections to be spaced apart when chairs are stacked.

In some cases two or more chairs are provided in a stacked configuration. The first chair is configured to stack on the second chair such that the second surface the second chair is in contact with the first surface of the first chair. In this configuration, the first sections of the chairs are spaced apart. The first and second surfaces of the respective chairs may nest where contact occurs due to the matching profiles. It is understood that only part of the surfaces may be in contact/nest.

In some cases a contact area is defined where the surfaces meet and the second thickness may be measured from a point in the contact area. The contact area may be 25%-100% or 50%-75% of a size of the first surface. The contact area may be at least 75% of the size of the first surface.

A guard may be connected to the first section and may extend below a bottom of the first section at a distance corresponding to a difference between the first thickness and second thickness. The guard may define top and bottom surfaces having matching profiles. This guard may also cover space between the first section and the seating portion where the rotation mechanism is housed in order to avoid or reduce the possibility of pinching of fingers in this space.

In some cases a rolling support has two axles spaced apart and receives the stacking chairs thereon such that a center of gravity of the stack of chairs is located between the two axles. In some configurations, thirteen chairs or possibly more can fit on the rolling support within eighty inches.

In other aspects the chair is provided with a leg portion of the frame having a first thickness. At least one cross section of the backrest portion may define a set of two profiles of matching shape one of which corresponds to a backrest surface. At least one of the seating or backrest surfaces may be curved in a first plane perpendicular to a second plane corresponding to the set of two profiles. A second thickness may be defined between the set of two profiles where the second thickness is greater than the first thickness. This may enable the leg portions of chairs to be spaced apart when stacked.

The curve in the first plane may also center the chairs relative to each other when stacked to avoid or reduce frame to frame contact where the first portion of one chair is approximately perpendicular to or overlaps the top of the leg.

In some cases a first section of the frame has a third thickness, and the seating portion is connected to the first section at a rotation axis. A fourth thickness may be defined between first and second surfaces of the seating portion wherein the fourth thickness is greater than the third thickness. This may avoid contact between the first sections of two chairs when stacked.

The seating portion may be configured to rotate freely relative to the frame between first and second positions such that an angle of rotation between the first and second positions is greater than 90 degrees. In some cases the set of two profiles correspond to at least 50% or at least 75% of the first and second surfaces.

In other aspects a folding chair is provided. A seating portion of the chair has first and second surfaces and an interior cavity. The interior cavity may have a compressible padding material. The seating portion may be connected to and configured to rotate relative to the frame about a rotation axis between first and second positions such that an angle of rotation between the first and second positions is greater than 90 degrees. This may enable added spacing in aisles/rows of seats as people fill in the rows.

Rotation from the first position towards the second position may move the seating portion towards a rotational equilibrium is caused by weight imbalance of the seating portion. The weight imbalance may exist in the first position and be relative to the rotation axis when no added weight or no user is on the seating surface. This may allow the seating portion to move an end of the seating element past a vertical axis passing through the rotation axis.

A front leg section of the frame may extend along a leg axis and in the second position, the seating portion may align parallel to the leg axis. A rotational equilibrium position of the seating portion may be defined where the seating portion is balanced about the axis of rotation. The rotational equilibrium position may be located at an angle relative to the first position that is greater than the angle of rotation. This may enable the seating portion to rotate easily.

In some cases a backrest portion is connected to the frame and may prevent rotation of the seating portion beyond the angle of rotation.

An improved covering system is also contemplated. The chair may have a frame defining a backrest support. A channel may be connected to the frame and may have at least one inwardly turned rib and an inner void. A cover may have an open end and two sides, the open end configured to receive the backrest support. A section of the open end may define an elongated loop extending in a direction between the two sides. A c-shaped elongated member may be configured to insert into the elongated loop such that the rib can be positioned between two parts of the elongated loop and the two parts are clamped within the c-shaped elongated member to secure the cover to the frame.

In some cases. A cross section of the seating portion and a cross section of the backrest portion of the chair may each define two matching profiles corresponding to at least part of the first and second surfaces. At least one pair of the two matching profiles may be curved. In some cases, the seating portion rotates about an axis located between the first and second surfaces of the seating portion.

Other objects of the invention and its particular features and advantages will become more apparent from consideration of the following drawings and accompanying detailed description.

DETAILED DESCRIPTION OF THE INVENTION

Figure 1:
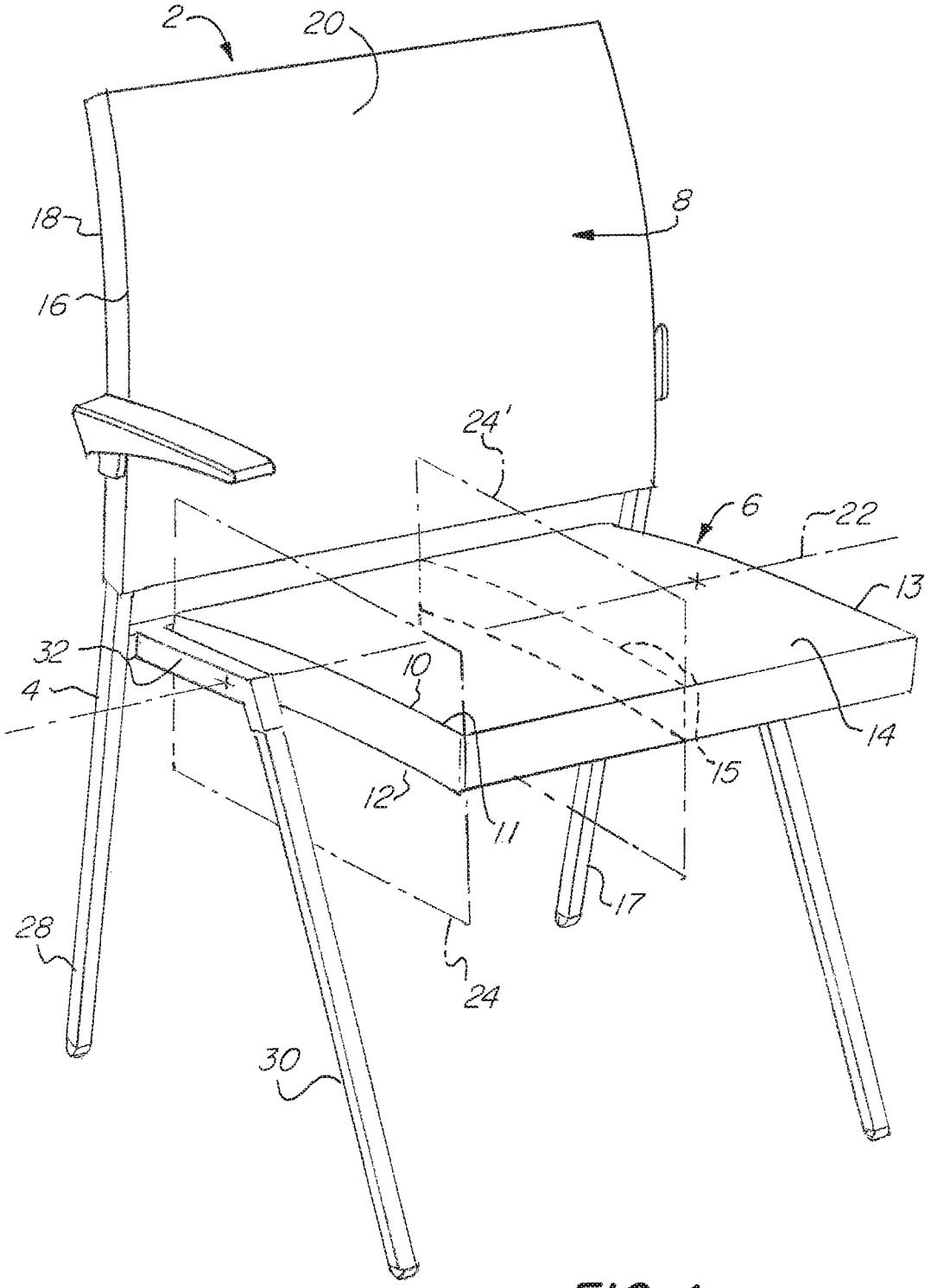
FIG. 1 is a perspective view of a chair as disclosed herein.

Referring now to the drawings, wherein like reference numerals designate corresponding structure throughout the views. The following examples are presented to further illustrate and explain the present invention and should not be taken as limiting in any regard.

Referring to FIG. 1, an exemplary chair 2 is shown with a frame 4, a seating portion 6 and a backrest portion 8. The seating portion 6 is connected to the frame 4 at axis 22. Axis 22 passes between the seating portion 6 between top profile 10 and bottom profile 12. In some embodiments, the axis 22 passes through the seating portion 6 closer to profile 12 than profile 10. The first set of profiles 10/12 of the seating portion 6 having matching curves. Although profiles 10/12 are shown at the edge of the seat, it is understood that the profiles could be considered at any cross section across the seating surface and the cross sections may be taken perpendicular to the axis 22 or in other orientations. As shown, the profiles 10/12 are the same across the entire width of the seating portion. See plane 24' showing cross section 15 with matching top and bottom profiles. In the embodiment shown, profiles 10/12 are the same as the profiles of cross section 15.

Figure 11:
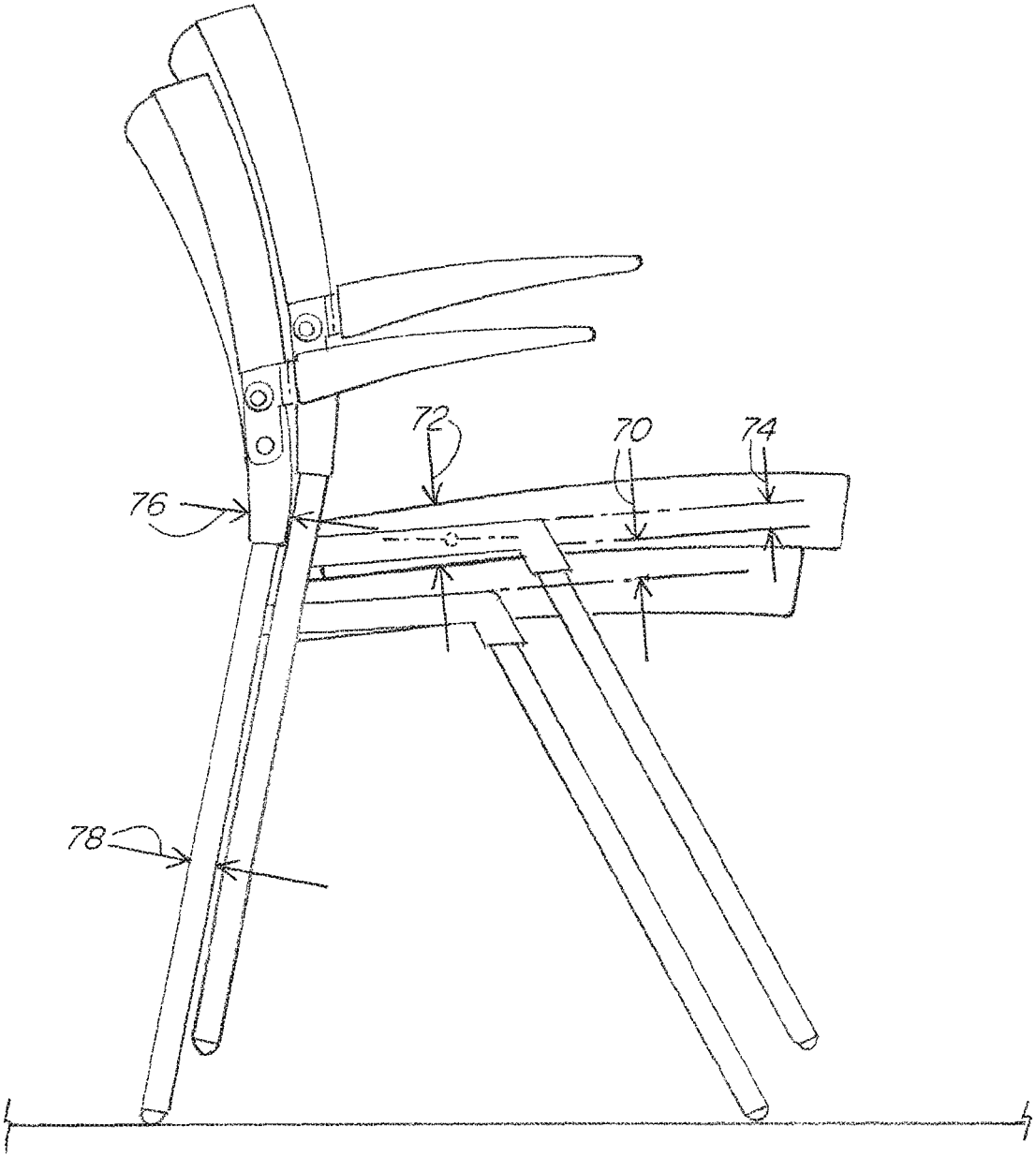
FIG. 11 is a side view of two chairs of FIG. 1 stacked on each other.
Figure 12:
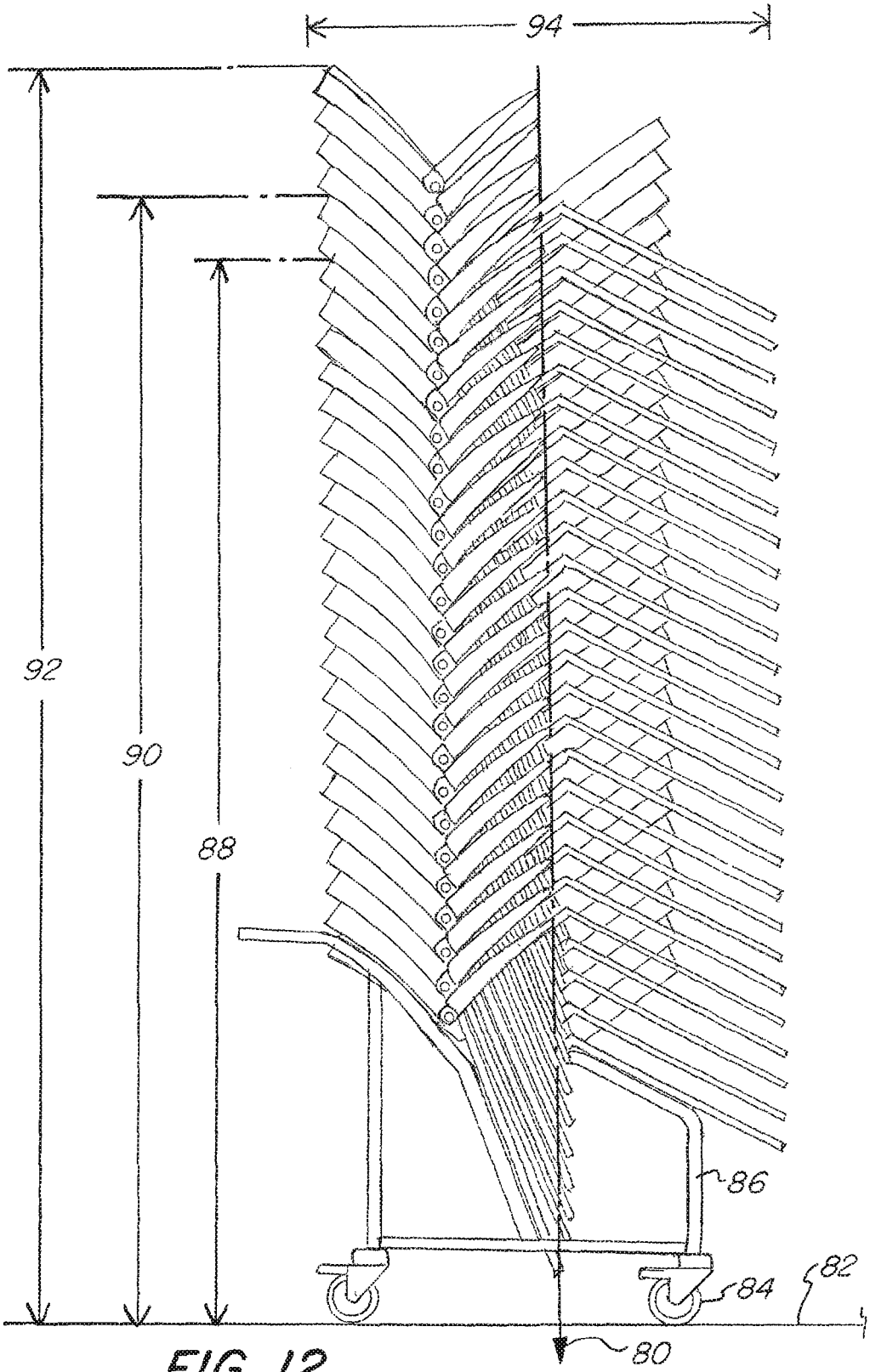
FIG. 12 is a side view of multiple chairs of FIG. 1 stacked on a trolley.
Figure 13:
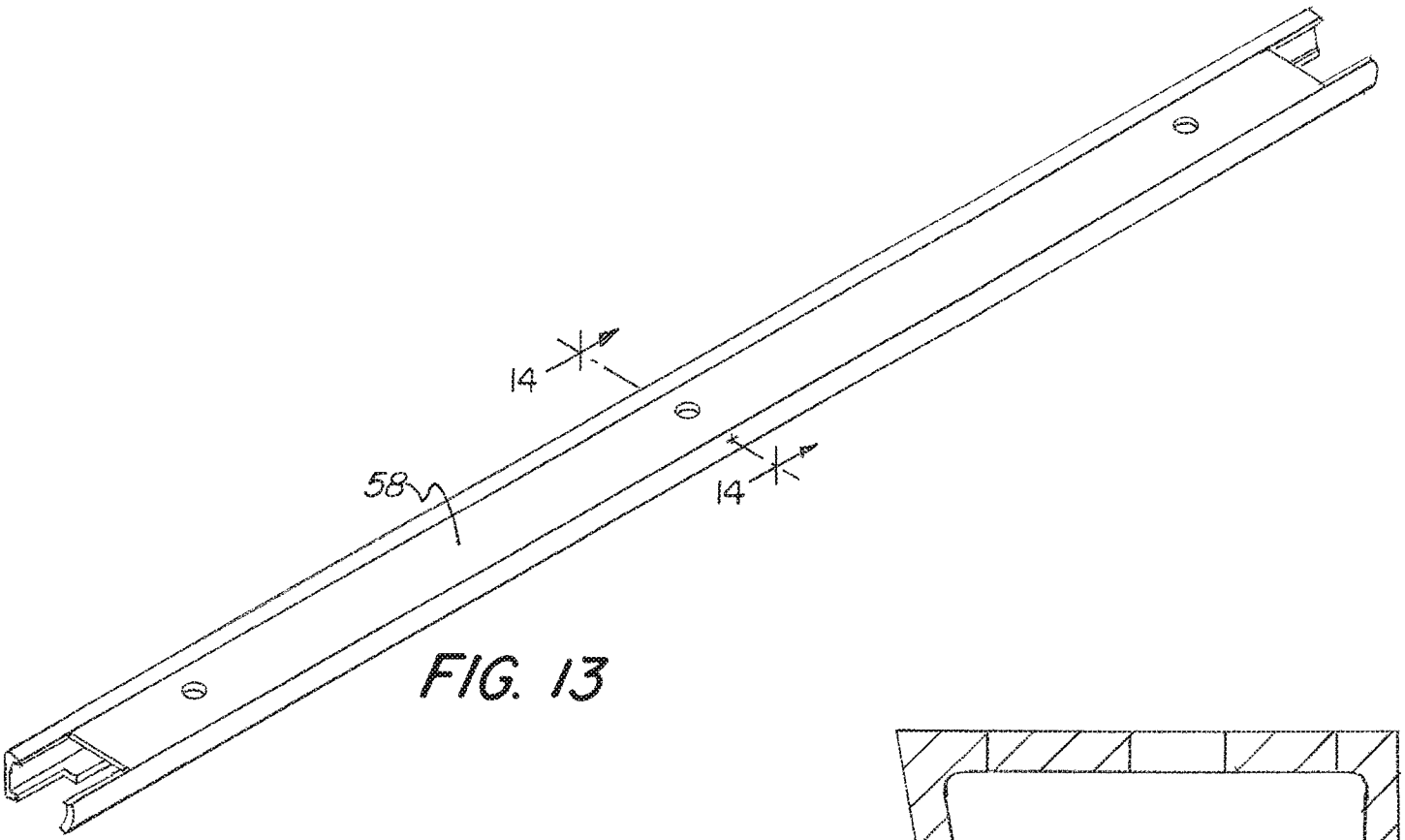
FIG. 13 is a perspective view of a frame piece for the chair of FIG. 1.
Figure 14:
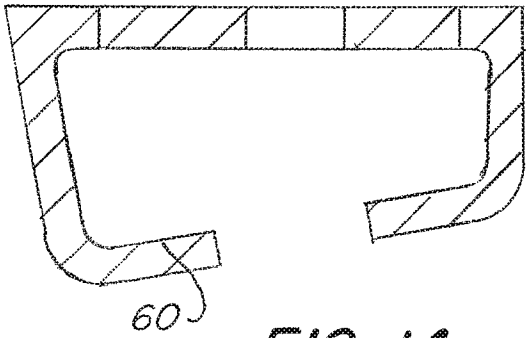
FIG. 14 is a cross section view of FIG. 13
Figure 15:
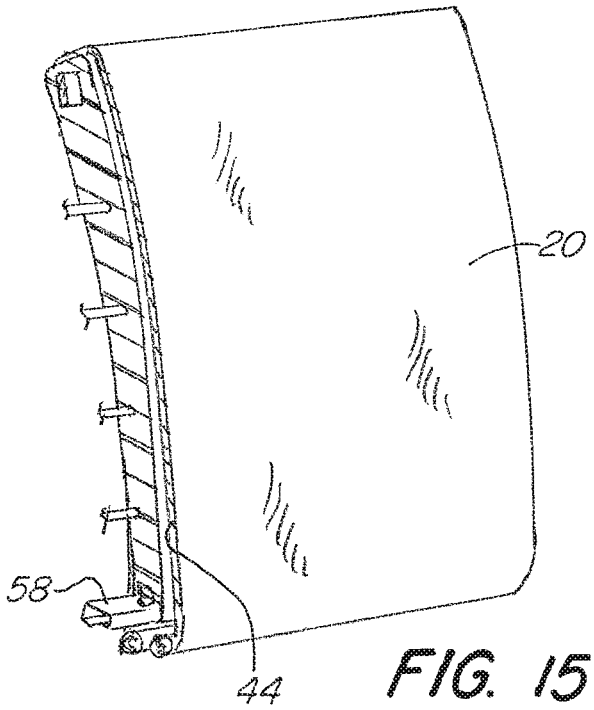
FIG. 15 is a cross section view of the backrest of the chair in FIG. 1.
Figure 16:
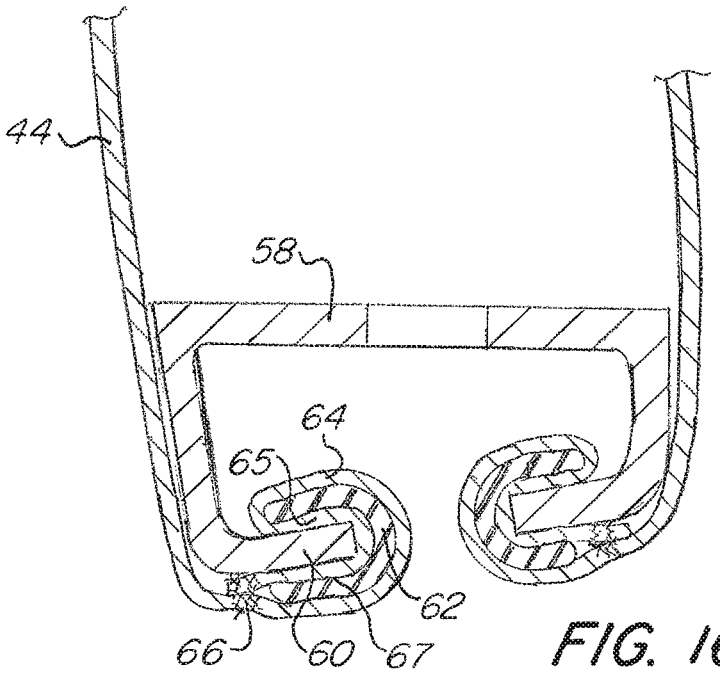
FIG. 16 is a detail cross section view of FIG. 15.

It is contemplated that the profiles at edges 11/13 could be different than the profiles in the middle plane 24'. However, the top profile and the bottom profile will match in order to allow for the chairs to be supported across a relatively large surface when stacked. It is contemplated that the profiles 10/12 may not match entirely. For example, a middle section of bottom profile 12 may taper towards the front face 17 of the seating portion 6 such that less than 100% of the top 10 and bottom 12 profiles match. Where the profiles match, the seating surface 14 of one chair would contact bottom surface 19 of another chair when the chairs are stacked. Additional cross section examples are shown in FIGS. 10-12.

The backrest portion 8 of the chair 2 may have similar matching characteristics to the seating portion. As one example backrest surface 20 has a profile 16 that matches profile 18. As with the seating portion, the profiles of the backrest portion can change across the backrest in the direction of the axis 22 or the chair can be designed such that less than 100% of the profiles match. In one embodiment, the profiles 10/12 and/or 16/18 can be a section of a circle having a radius. The radius corresponding to profile 10 could be different than profile 16. It is understood that the radius of profile 10 would match the radius of profile 12 and the radius of profile 16 would match the radius of profile 18. The centers of the corresponding radii of the profiles of two chairs when stacked may be spaced apart from each other at a distance corresponding to a thickness of the corresponding backrest/seating portion.

The backrest or seating portion or both may be curved in a plane 26 that is perpendicular to plane 24.

Figure 9:
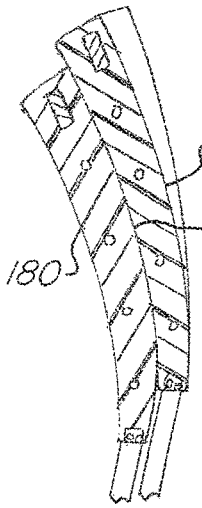
FIG. 9 is a section view of two chairs in FIG. 1 stacked with the section along line 9-9 of FIG. 10.
Figure 8:
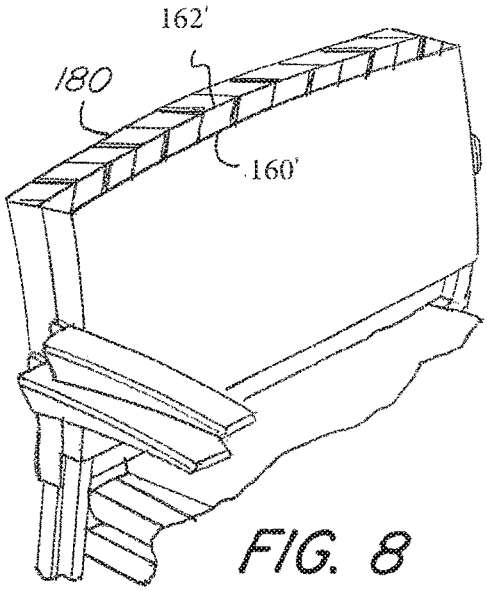
FIG. 8 is a section view of two chairs in FIG. 1 stacked with the section along line 8-8 of FIG. 10.
Figure 10:
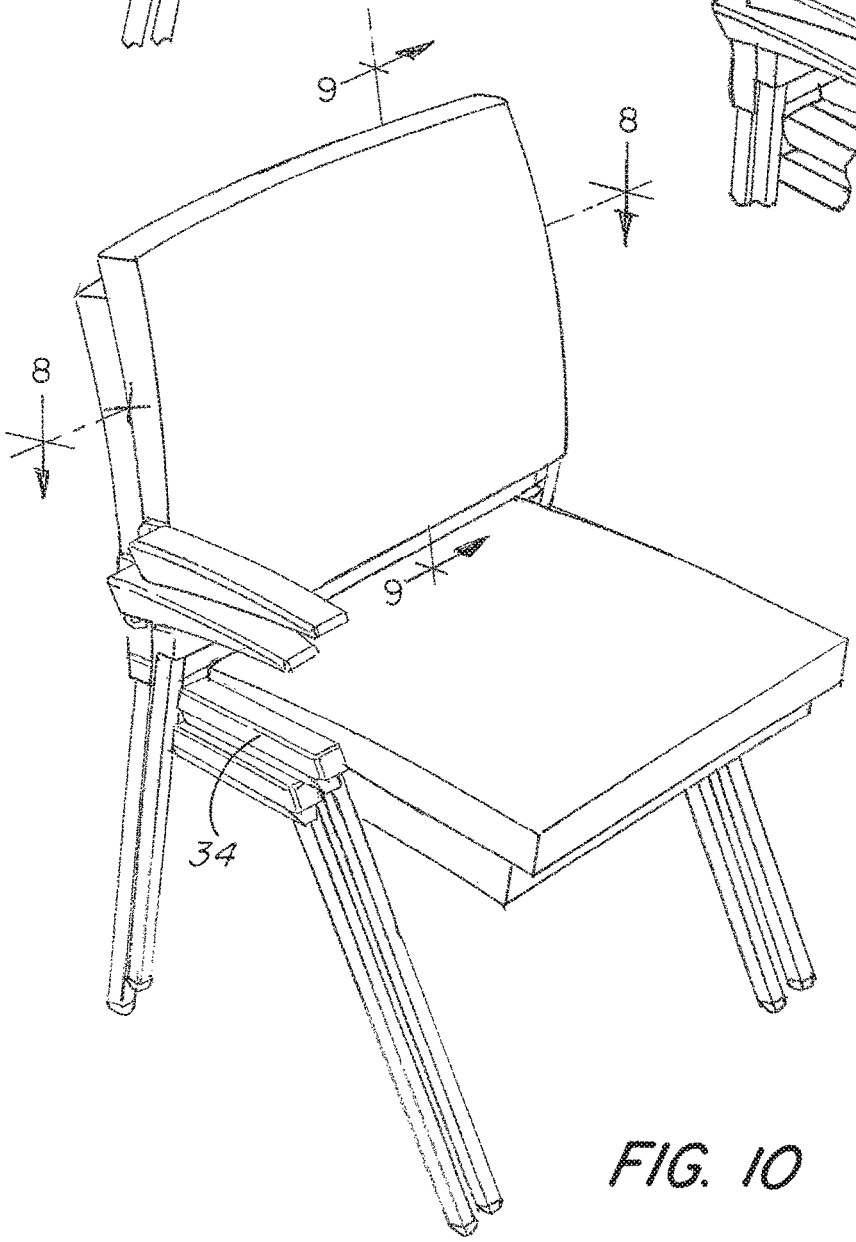
FIG. 10 is a perspective view of two chairs of FIG. 1 stacked and including a guard.

Referring to FIGS. 8-10, other examples of cross sections and their corresponding profiles 180/160 and/or 180'/160' are shown. As can be seen in FIG. 8, profile 160 and profile 162 nest together such that a front surface of the backrest is in contact with a rear surface of the backrest of a second chair. In FIG. 9, profile 160' and profile 162' nest together such that a front surface of the backrest is in contact with a rear surface of the backrest of a second chair.

Figure 3:
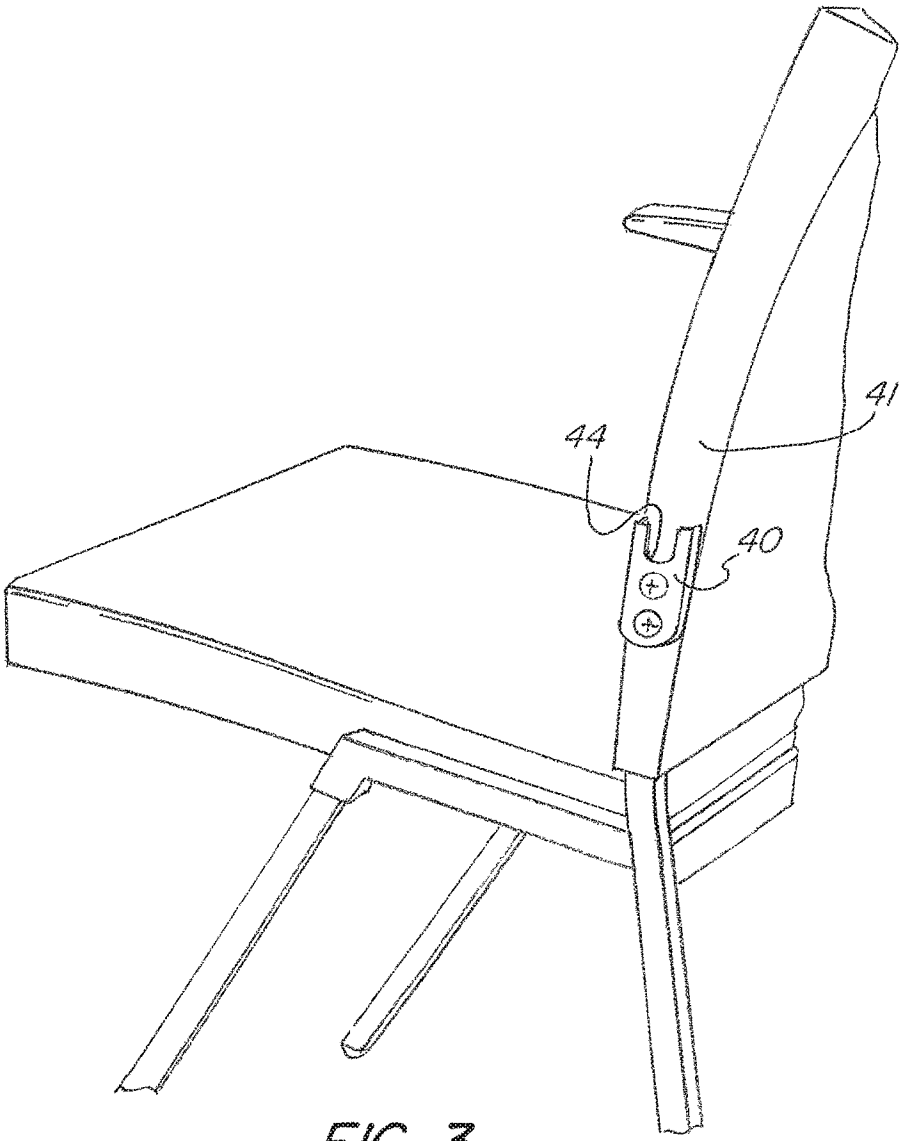
FIG. 3 is a left side partial perspective view of the chair of FIG. 1.
Figure 2:
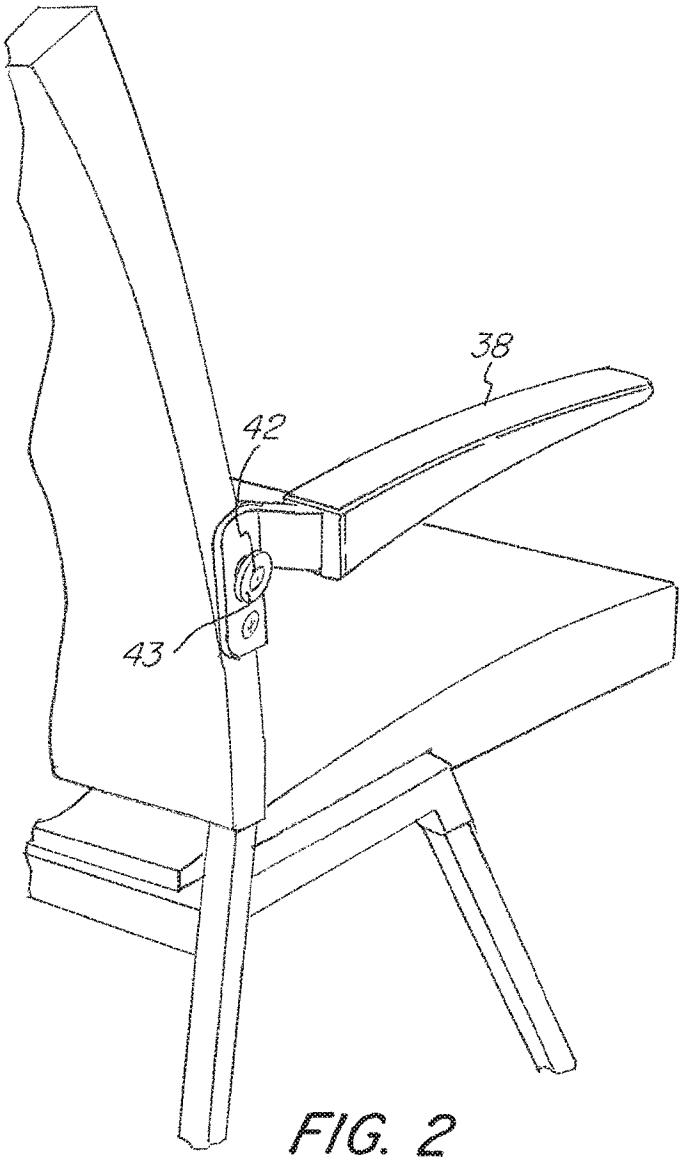
FIG. 2 is a right side partial perspective view of the chair of FIG. 1.

In FIGS. 2 and 3, the chair 2 is shown with a single sided arm configuration. The arm 38 in this example is attached to the right side of the chair and securing member 42 extends from the base of the arm near the frame. A female securing member 40 is on the opposite (left) side of the chair and includes channel 44 that receives securing member 42 and the chair is built without an arm on the opposite (left) side, however the chair could be built with two arms. The securing member as shown has an intermediate diameter/size that fits in the channel 44 and end 43 is larger than the opening in the channel and fits between the side 41 of the backrest and the inner surface of the securing member 40 that faces the side 41. The securing member is typically inserted into the channel 44 from top to bottom, but the reverse assembly configuration is contemplated as well. The chair 2 can also be built with no arms and still use the securing system shown and described herein.

Figure 4:
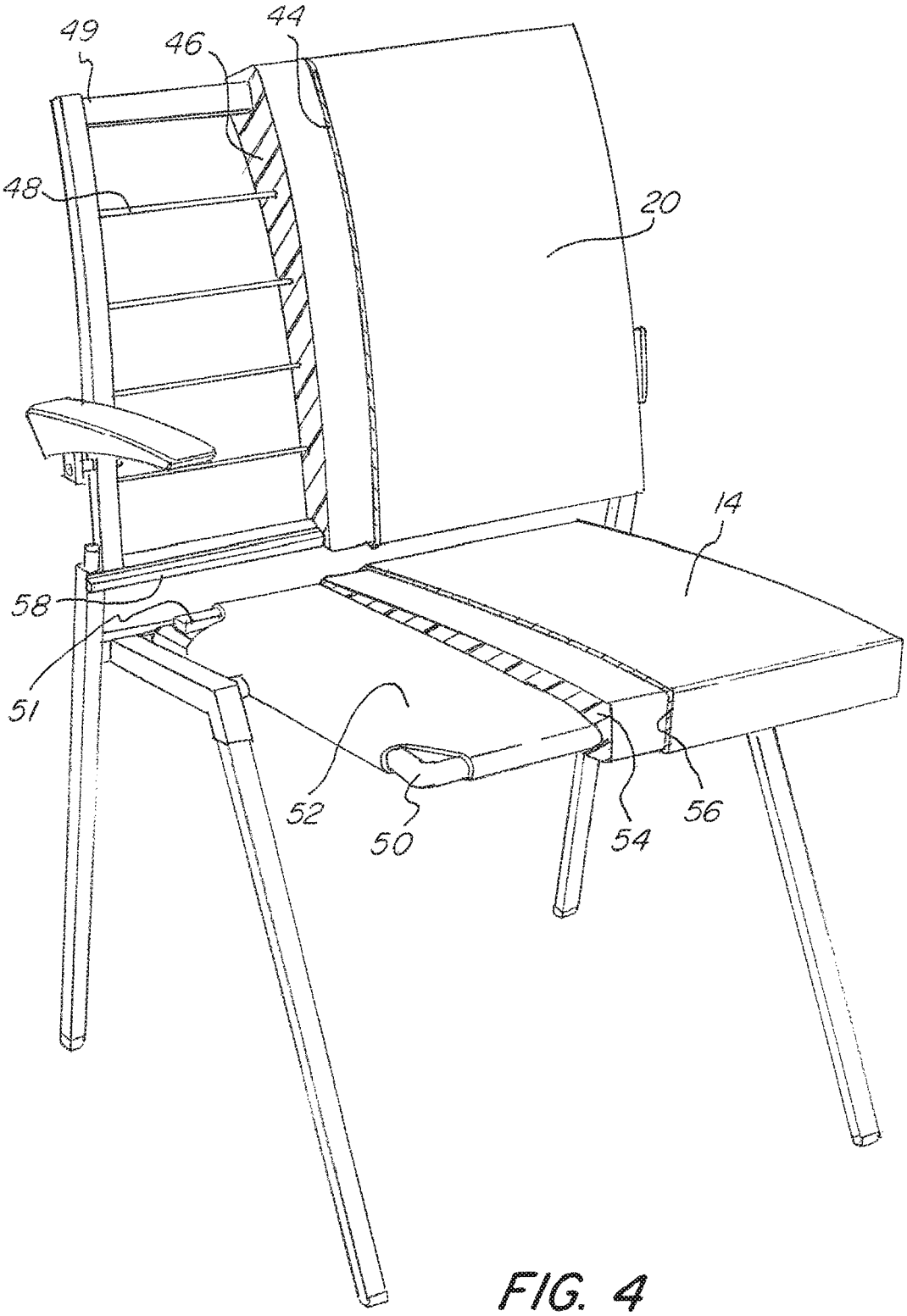
FIG. 4 is a cutaway view of the chair of FIG. 1.

In FIG. 4, additional detail regarding the inner structure of the seating and backrest portions is shown. The backrest portion includes support wires 48 and an internal frame 49/58. Foam 46 is molded around the internal frame and wires to create the padding for the backrest. The foam 46 may be injection molded. For examples of injection molded seating elements with internal frames, see U.S. Pat. No. 7,690,732, the content of which is incorporated by reference herein. Frame piece/channel 58 may be partially exposed in order to allow for attachment of the seat cover 44 as more fully shown and described with reference to FIGS. 13-16.

As also shown in FIG. 4 the seating portion may include an inner frame 50 a webbing 52 or other support structure/member, injection molded foam 54 and cover 56. At the rear of the frame is weight 51. This weight induces rotation of the seat when a user stands up and allows the seat to rotate freely. As also shown, more foam 54 is on the top side of the frame 50 than on the bottom. This causes a rotational instability that allows the seating portion to rotate past 90 degrees as shown and described in reference to FIG. 7.

Figure 5:
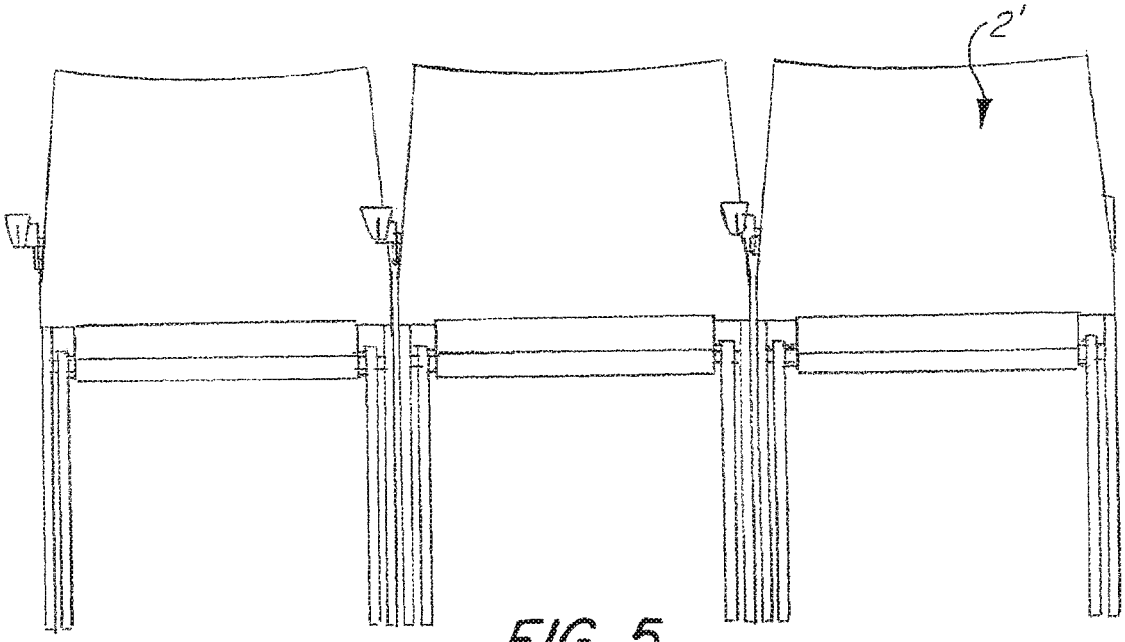
FIG. 5 is a front view of a row of chairs according to FIG. 1.
Figure 6:
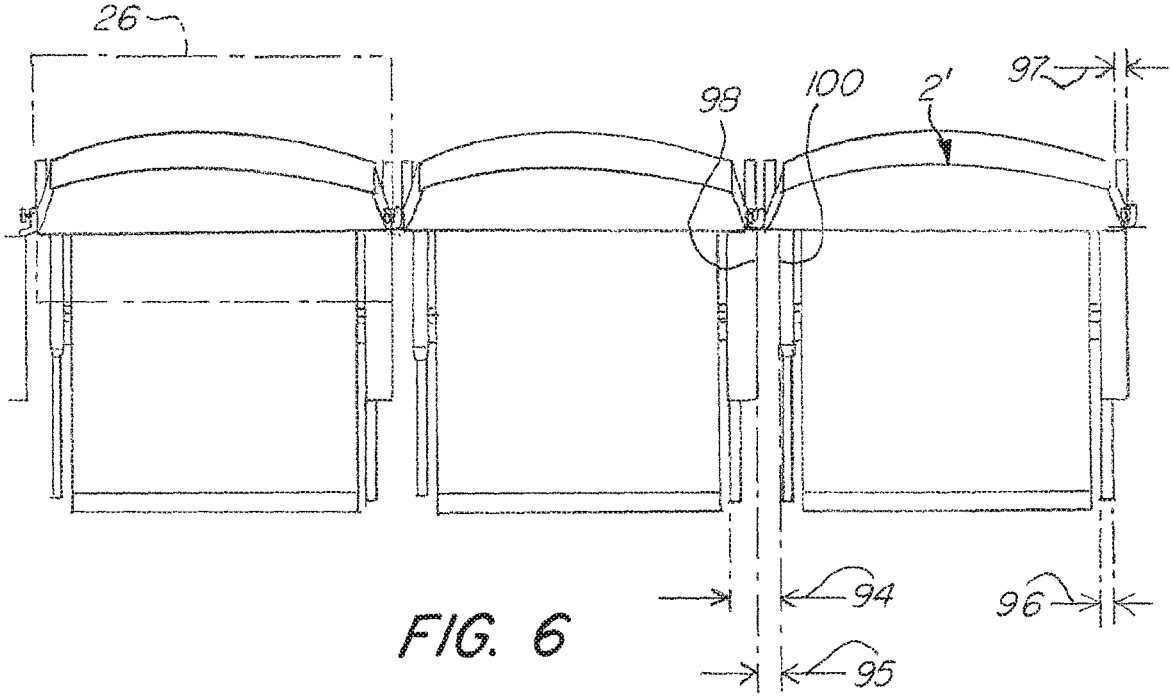
FIG. 6 is a top view of a row of chairs according to FIG. 1.

In FIG. 5, three chairs are shown aligned in a row. Although not shown, it is contemplated that end chair 2' could include two arms with the remaining chairs including a single arm as described previously. In the top view shown in FIG. 6, the inner edge 98 of the arm of chair 2' is shown spaced apart from outer edge 100 of the first portion of the frame. The distance 95 is preferably larger than the width 97 of the rear leg. This allows for sufficient space during stacking. Also, since the chairs are configured with single arms and the legs insert between the arm and the frame, the use of a single arm also saves a considerable amount of space. As one example, distance 94 may be approximately 4 inches. If each chair had two arms, an additional 4 inches per seat would be needed. With rows of 20 seats, an additional 80 inches is provided, which could accommodate two or more additional chairs per row. The spacing 95 may also be in reference to guard 34 which is not shown in FIG. 6.

Figure 7:
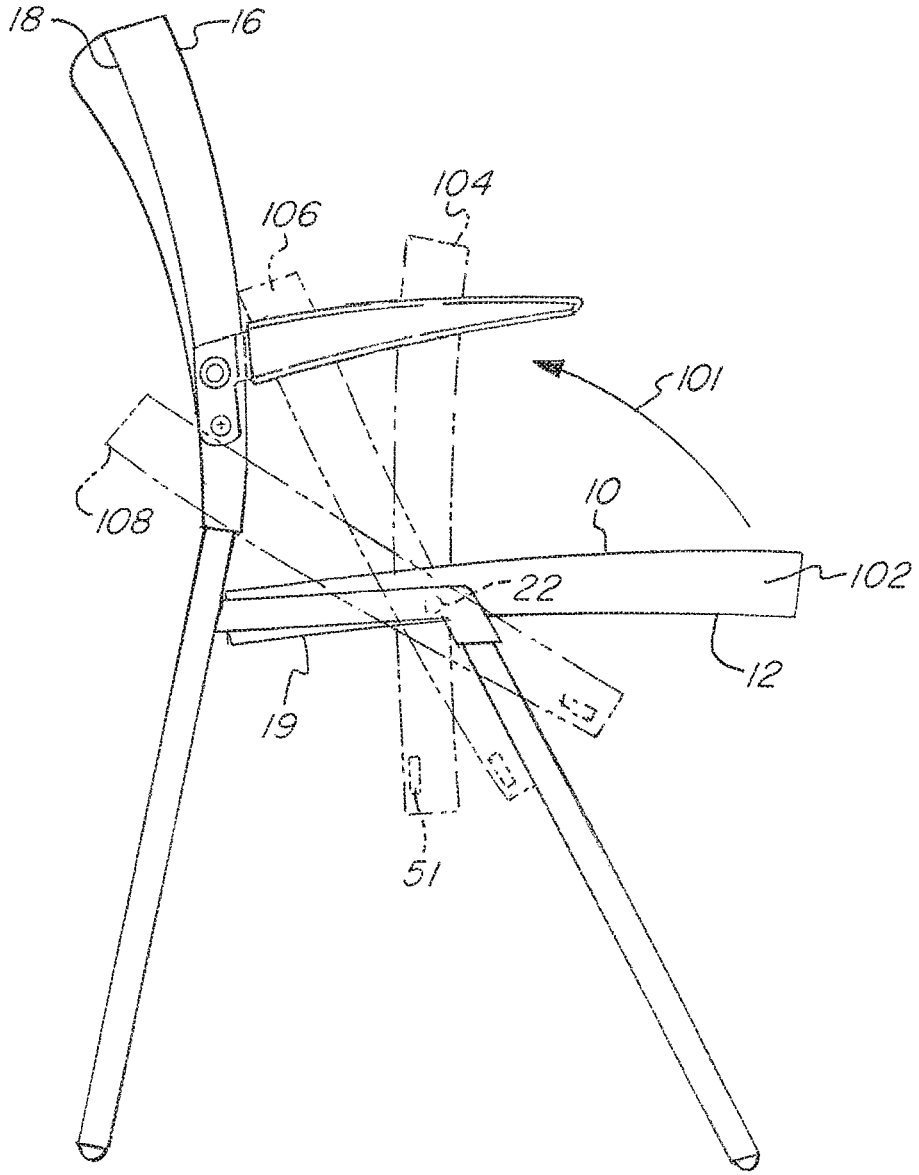
FIG. 7 is a side view of FIG. 1.

Referring to FIG. 7, the seating portion is shown in first position 102, which would be the position where someone is sitting on the chair. When weight is removed from the chair, the seating portion will rotate 101 towards position 106 and through position 104. Also shown is rotational equilibrium position 108 of the seating portion relative to axis 22. This position 108 is due to the weight 51 being positioned above axis 22 in position 102 and more foam being positioned above the inner frame 50 than below and the positioning of axis 22 relative to the seating portion. This causes the seat to have a tendency to move towards position 108, however the seating portion stops at position 106 due to contact with the backrest portion. The rotation shown in FIG. 7 is due to weighting without other mechanical forces such as springs or elastic materials or motors.

In FIGS. 8-10, additional cross sections are shown in the example of two stacked chairs to show how various profiles match and nest when chairs are stacked. For example, profiles 180 and 160 match and profiles 162 and 160 nest together when stacked. Referring to FIG. 9, the vertical profiles 162'/160'/180' may be a radius of a circle since when the chairs stack, the backrest and seating portions are slightly offset with respect to each other. Since the profiles are a constant radius, there is consistent contact between the respective surfaces to distribute weight of the chairs across a relatively large surface.

In FIG. 11, two chairs are shown stacked together. As shown, the thickness 72 of the seating portion is larger than the thickness 74 of the first portion of the frame. This causes the bottom of the first portion of the top chair to be spaced apart at a distance 70 from the top of the first portion of the bottom chair. Distance 70 in this case is equal to the difference between distance 72 and 74. Also shown is thickness 76 of the backrest is greater than thickness 78 of the leg.

In some cases a large number of chairs, possibly up to 16 or more (depending on the thickness of the seating/backrest portions) may be stacked in the horizontal configuration show in FIG. 11 with the center of gravity of the stack still between the bases of the legs. This may prevent the stack from toppling/rotating over around the front leg in storage without the dolly shown in FIG. 12.

In FIG. 12, twenty-seven (27) chairs are shown stacked together. As can be seen the profiles of each chair match. In the configuration shown, the profiles are sections of a circle, which allows the chairs to nest such that the front faces of the seating portions are offset slightly with respect to each other. As can also be seen, the chairs stack vertically such that the center of gravity of each chair and the center of gravity of the stack aligns along axis 80. As shown, axis 80 is located between wheels of the dolly 86. In the example shown, distance 88 is 80 inches or slightly smaller in order to accommodate a door frame height of 80 inches and fit 21 chairs therein. As also shown, 22 chairs fit within 84 inches (distance 90) and 27 chairs fit within 96 inches (distance 92).

FIGS. 13-16 show a chair covering system. Channel 58 is connected to the frame as previously shown. This channel 58 includes two inwardly turned ribs 60. The cover 44 includes loops at the open end. The loops may be formed by sewing 66 an end of the fabric of the cover 44 on an intermediate portion of the fabric of the cover 44. To install the chair, C-shaped elongated clips 62 are inserted into the loops and clipped over the inwardly turned ribs 60. The C-shaped clips are shown rounded but could include or be made entirely of straight sections. The cover 44 is placed under tension and the clips engage against the rib 60 such that portions 65/70 are between the clip 62 and the rib 60. To remove the cover, the cover 44 is pulled down and the clips 62 are removed from the ribs 60 to release the cover 44 from the channel 58. The cover 44 may have holes therein that align with the arm 38 and the female securing member 44 when the cover is inserted over the backrest such that these parts can be bolted/secured after covering.

Figure 17:
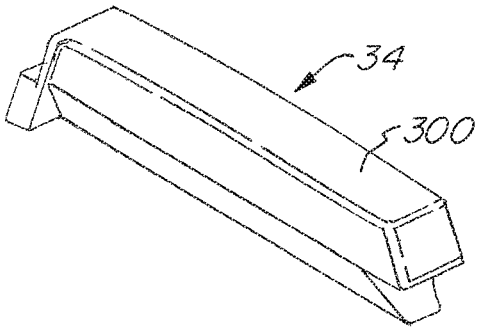
FIGS. 17-19 are perspective views of the guard for the chair of FIG. 1.
Figure 18:
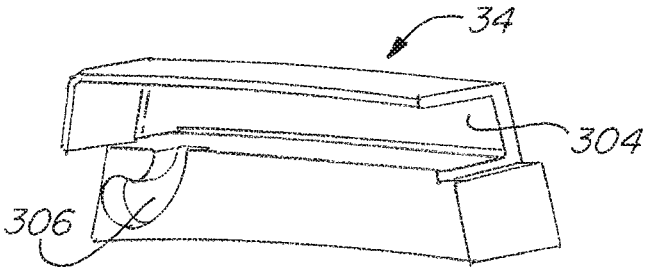
Figure 19:
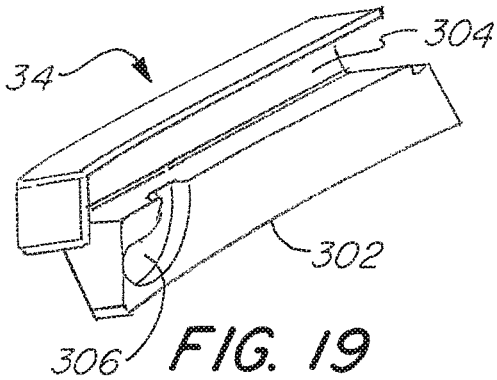

The guard 34 is shown in FIGS. 17-19. This guard includes top 300 and bottom 302 surfaces that are spaced apart a distance that allows for the guard to fit between the first portions 32 of the chairs when stacked. Channel 306 allows stop 200 to rotate therein when the seating surface is folded to position 106. Channel 304 of the guard 34 fits around the first portion 32 and the lower portion below the guard is of a size slightly less than distance 74. For example, the sum of the thicknesses of the lower section below the channel 304 and the upper portion above the channel 304 may be equal to distance 74. The upper 300 and lower surfaces 302 may also be curved and can have matching profiles in order to allow for nesting of the guards in addition to nesting of the seating surfaces. The guard may be formed out of a plastic or rubber material.

Figure 20:
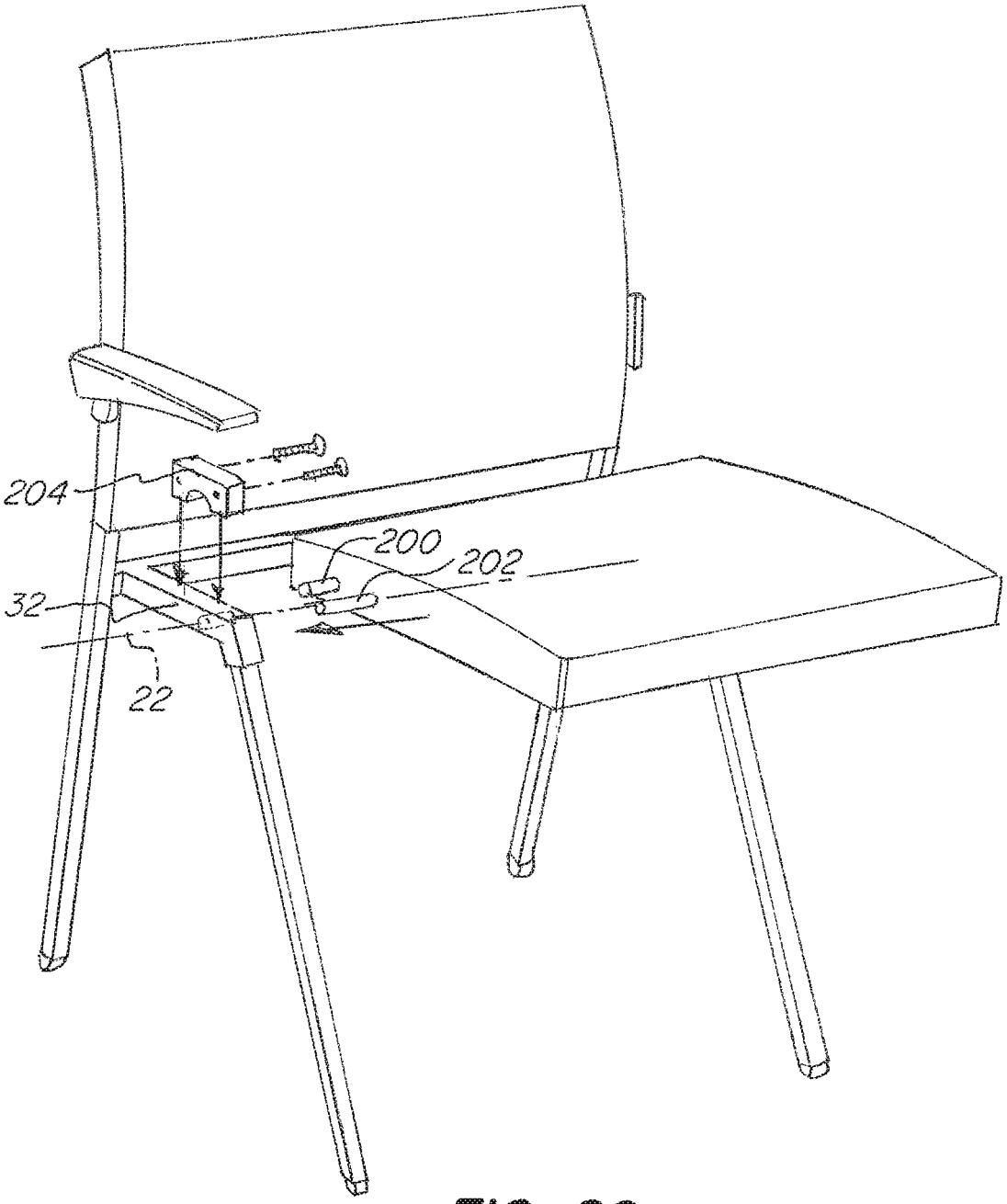
FIG. 20 is an exploded detail view showing the rotation and stop mechanism of the chair of FIG. 1.

In FIG. 20, the seating stop 200 is shown and interacts with stop 204 in position 102 when weight is on the seating surface (someone sitting on the chair). Pivot 202 rotates with respect to the frame to allow the seating portion to rotate relative to the frame.

Figure 21:
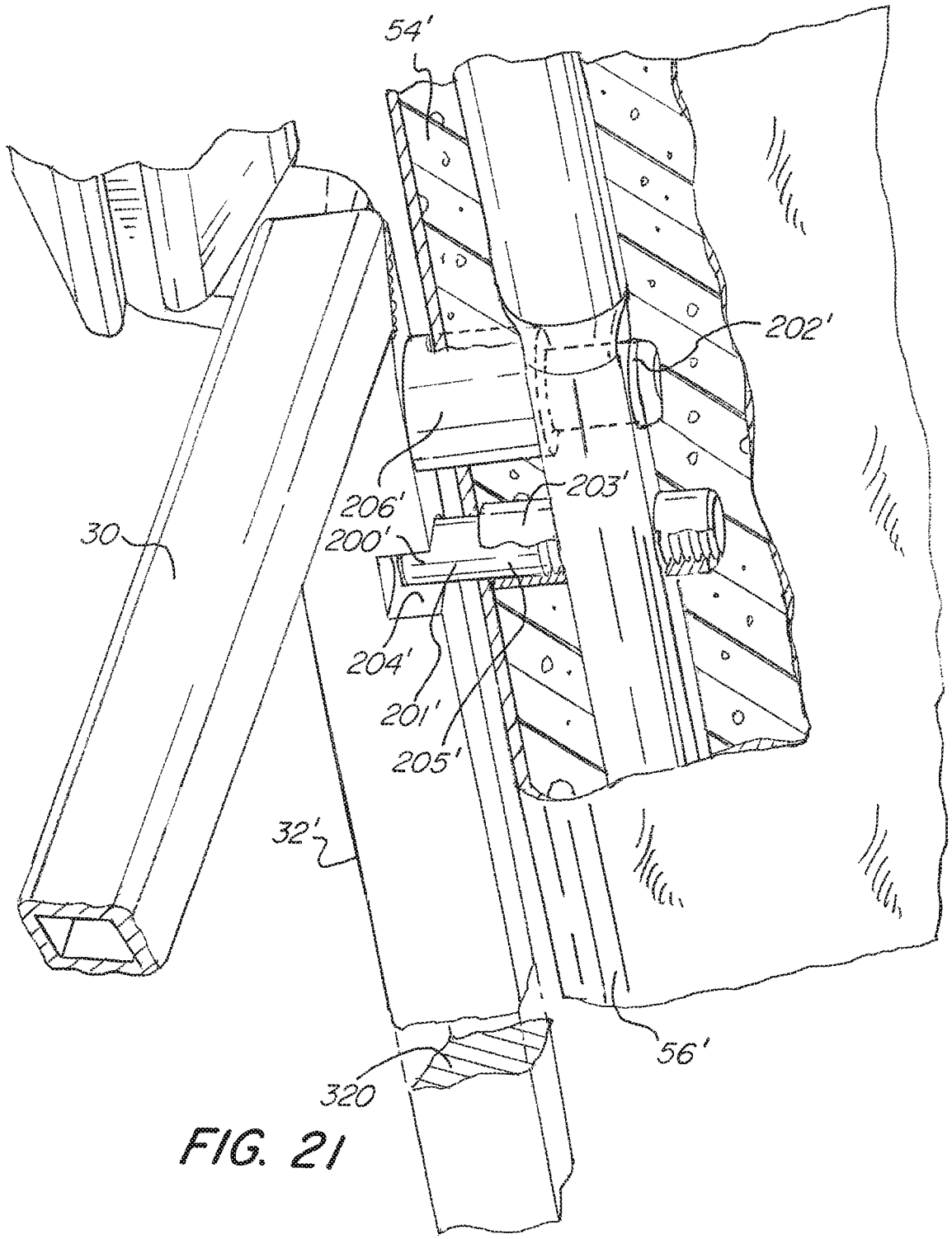
FIG. 21 is a bottom perspective partial cutaway view of an alternate rotation and stop mechanism for the chair of FIG. 1.

In FIG. 21, the seating stop 200' includes a threaded cylinder 203' that is shown passing through a hole in the seat frame. The cylinder 203' may be welded to the seat frame. Threaded rod 201' threads into the cylinder and section 205' close to the threads may be of a diameter larger than that of the outer threads. This reduces bending stresses on the threads, which would be apt to break in bending due to stress concentrations if the cylinder 203' was not used. Stop 204' is formed as a channel in first portion 32'. As shown, portion 32' is solid 320 and is welded to hollow leg 30. Rotation mechanism 206'/202' is shown to allow the seating portion to rotate relative to the frame. The outer portion 206' may be fixed relative to the frame and inner portion 202' may rotate therein. In other aspects, outer portion 206' may rotate relative to the frame and 202' may allow for removal of the seating portion from the frame. Cover 56' is shown very close to portion 32', and foam 54' may partially surround seating stop 200' and rotation mechanism 206'/202'. By placing the stop 204' in the portion 32' of the frame, stop 204 is not needed and there may be a savings space on each side of the seating portion. This space savings may be ¼ inch on each side which would allow the seating portion to be wider by approximately ½ inch. This may provide added comfort to the user.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A chair adapted to stack comprising:

a frame;

a seating portion connected to said frame;

a backrest portion connected to said frame;

a first set of two matching profiles defined by at least one cross section of said seating portion, the at least one cross section located in a second plane perpendicular to a first plane, and the first set of two profiles located on first and second surfaces of said seating portion, one of the first and second surfaces being a seating surface;

the first plane parallel to a width-wise axis of the chair which extends from left to right through the frame;

a second set of two profiles of matching curved shape defined by at least one cross section of said backrest portion, the at least one cross section of said backrest portion located in the second plane and the second set of two profiles located on first and second surfaces of said backrest portion and one of the first and second surfaces is a backrest surface; and at least one of the seating or backrest surfaces is curved in the first plane.

2. The chair of claim 1 wherein at least one profile of the first or second sets of two profiles correspond to at least 50% of the corresponding seating or backrest surfaces across the chair from left to right in a direction of the axis.

3. The chair of claim 1 wherein at least one profile of the first or second sets of two profiles correspond to at least 75% of the corresponding seating or backrest surfaces across the chair from left to right in a direction of the axis.

4. The chair of claim 1 further comprising:

the frame having a first section with a first thickness, and the seating portion connected to the frame at the first section;

a guard connected to the first section and extending below a bottom of the first section at a distance corresponding to a difference between a thickness of the seating portion and the first thickness of the frame measured at the seating portion.

5. The chair of claim 4 wherein the guard defines top and bottom surfaces having profiles that match.

6. The chair of claim 1 wherein the backrest portion includes a compressible padding material between the second set of two profiles and the second set of two profiles are spaced at a distance greater than a thickness of the frame of the chair at the backrest.

7. The chair of claim 1 further comprising an interior cavity of said seating and backrest portion each including an internal frame and a compressible padding material injection molded around the internal frame such that a portion of the compressible padding material is located above the internal frame and below the internal frame on said seating portion and in front of said internal frame and behind said internal frame on said backrest portion.

8. A system of multiple chairs comprising:

a first one of at least two chairs;

a second one of at least two chairs;

the at least two chairs each having: a frame including a first section defining a first thickness; a seating portion; and a backrest portion, the seating portion connected to the first section at the first section of the frame through which a width-wise axis passes through, the width-wise axis extending from left to right of the at least two chairs and the width-wise axis located between first and second surfaces of said seating portion wherein at least part of said first surface of said seating portion and at least part of said second surface of said seating portion define a first set of two matching profiles and said first surface of said seating portion is a seating surface, the backrest portion having first and second surfaces wherein at least part of the first surface of the backrest portion and at least part of the second surface of the backrest portion define a second set of two matching profiles and said first surface of said backrest portion is a backrest surface, and at least one of the first set or the second set of two matching profiles is curved, and a second thickness measured between said first and second surface is greater than the first thickness;

the first one of the at least two chairs configured to stack on the second one of the at least two chairs such that the at least part of the second surface of the second one of the at least two chairs is in contact with the at least part of the first surface of the first one of the at least two chairs such that the first sections of the at least two chairs are spaced apart.

9. The system of multiple chairs of claim 8 further comprising:

a rolling support having two axles spaced apart and receiving the at least two stacking chairs which includes at least thirteen chairs and a center of gravity of the at least thirteen chairs is located between the two axles with a height measured vertically from a floor to a top of the at least thirteen chairs being less than eighty inches.

10. The system of multiple chairs of claim 8 wherein:

the seating portion is configured to move between open and closed positions, the open position being with the seating portion generally horizontal and the first and second ones of the at least two chairs stack together with the seating portion in the open configuration.

11. The system of multiple chairs of claim 8 wherein both the first set and the second set of two matching profiles are curved.

12. The system of multiple chairs of claim 8 further comprising:

a contact area is defined where the first surface of the first one of the at least two stacking chairs and the seating surface of the second one of the at least two stacking chairs meet;

wherein the second thickness is measured from a point in the contact area.

13. The system of multiple chairs of claim 12 wherein the contact area of the first surface of the first one of the at least two stacking chairs is at least 50% of a size of the first surface of the first one of the at least two stacking chairs.

14. The system of multiple chairs of claim 13 wherein the contact area of the first surface of the first one of the at least two stacking chairs is at least 75% of the size of the first surface of the first one of the at least two stacking chairs.

15. A chair adapted to stack comprising:

a frame including a first section defining a first thickness;

a seating portion connected to the first section at an axis, the axis extending left to right on the chair in a width-wise direction, the axis located between first and second surfaces of said seating portion wherein at least part of said first surface and at least part of said second surface define two matching profiles which are curved;

a second thickness measured between said first and second surface is greater than the first thickness; and a guard connected to the first section and extending below a bottom of the first section at a distance corresponding to a difference between the first thickness and second thickness.

16. The chair of claim 15 wherein the guard defines top and bottom surfaces having matching profiles.

17. The chair of claim 15 further comprising:

a rolling support having two axles spaced apart and receiving the at least thirteen chairs adapted to stack such that a center of gravity of each of the at least thirteen chairs is located between the two axles and when stacked and the first surface each of the chairs contacts the second surface of an adjacent chair except for lowest and a highest chair in the stack.

18. The chair of claim 17 wherein a height measured vertically from a floor to a top of the at least thirteen chairs is less than eighty inches.

19. The chair of claim 15 further comprising a backrest connected to the frame at least one cross section of said backrest portion defining another set of two profiles of matching curved shape, the another set of two profiles located on respective ones of first and second surfaces of said backrest portion, one profile of the another set of two profiles is located on a backrest surface, wherein a thickness between the another set of two profiles is greater than a thickness of the frame of the chair at the backrest.

* * * * *